US012605595B2

(12) United States Patent
Plaze et al.

(10) Patent No.: US 12,605,595 B2
(45) Date of Patent: Apr. 21, 2026

(54) CAMMING CLAMPING DEVICE, METHOD FOR MANUFACTURING ONE SUCH DEVICE AND METHOD FOR REPLACING A WIRE ELEMENT OF ONE SUCH DEVICE

(71) Applicant: ZEDEL, Crolles (FR)

(72) Inventors: Pierre Plaze, Chignin (FR); Aurélie Bergez, Gières (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 18/543,947

(22) Filed: Dec. 18, 2023

(65) Prior Publication Data

US 2024/0207685 A1 Jun. 27, 2024

(30) Foreign Application Priority Data

Dec. 22, 2022 (FR) ..... 2214249

(51) Int. Cl.
*A63B 29/02* (2006.01)

(52) U.S. Cl.
CPC ..... *A63B 29/024* (2013.01)

(58) Field of Classification Search
CPC ..... A63B 29/024; A63B 2225/09
See application file for complete search history.

(56) References Cited

U.S. PATENT DOCUMENTS

| | | | |
|---|---|---|---|
| 4,184,657 | A | 1/1980 | Jardine |
| 4,513,641 | A | 4/1985 | Murray et al. |
| 4,565,342 | A | 1/1986 | Grow |
| 4,575,032 | A | 3/1986 | Taylor |
| 4,645,149 | A | 2/1987 | Lowe |
| 4,832,289 | A | 5/1989 | Waggoner |
| 5,860,629 | A | 1/1999 | Reed |
| 6,679,466 | B2 | 1/2004 | Brown |
| 6,736,359 | B2 | 5/2004 | Murray |
| 7,278,618 | B2 | 10/2007 | Tusting et al. |
| 9,302,154 | B2 | 4/2016 | Steck et al. |
| 10,143,892 | B2 | 12/2018 | Baker et al. |
| 10,463,916 | B2 | 11/2019 | Davidson |

(Continued)

FOREIGN PATENT DOCUMENTS

| | | | |
|---|---|---|---|
| DE | 28 24 654 | A1 | 12/1978 |
| DE | 102015213205 | A1 | 1/2017 |

(Continued)

OTHER PUBLICATIONS

Nov. 20, 2024 Office Action issued in U.S. Appl. No. 18/538,412.

(Continued)

*Primary Examiner* — Kimberly T Wood
(74) *Attorney, Agent, or Firm* — Oliff PLC

(57) ABSTRACT

A camming clamping device comprises a head provided with an anchor point. A cam is installed rotatable around at least one shaft between a retracted position and an extended position. A spring is functionally coupled to the cam to bias the at least one cam to the extended position. An annular end is mechanically coupled to the head. A wire element connects the head and the annular end. The wire element is in the form of a ring. The ring is folded into a U-shape with two legs joined by a central portion. The two legs are fixed to the anchor point. Four strands of the wire element connect the head and the annular end. An actuating system has a trigger installed slidingly and configured to selectively engage the retracted position.

13 Claims, 5 Drawing Sheets

(56) References Cited

U.S. PATENT DOCUMENTS

| | | | |
|---|---|---|---|
| 11,383,136 | B2 | 7/2022 | Steck et al. |
| 2004/0035992 | A1 | 2/2004 | Watts |
| 2006/0231708 | A1 | 10/2006 | Robertson et al. |
| 2015/0001360 | A1 | 1/2015 | Czech |
| 2020/0034075 | A1 | 1/2020 | Li et al. |
| 2021/0001181 | A1 | 1/2021 | Steck et al. |

FOREIGN PATENT DOCUMENTS

| | | | |
|---|---|---|---|
| DE | 112020005469 | T5 | 9/2022 |
| EP | 0 226 829 | A1 | 7/1987 |
| ES | 2639103 | T3 | 10/2017 |
| GB | 2 158 540 | A | 11/1985 |
| GB | 2 369 068 | A | 5/2002 |
| GB | 2 380 949 | A | 4/2003 |
| GB | 2 461 807 | A | 1/2010 |
| WO | 2014/152150 | A1 | 9/2014 |

OTHER PUBLICATIONS

Nov. 25, 2024 Office Action issued in U.S. Appl. No. 18/537,908.
U.S. Appl. No. 18/538,412, filed Dec. 13, 2023 in the name of Plaze et al.
U.S. Appl. No. 18/537,908, filed Dec. 13, 2023 in the name of Plaze et al.
Apr. 9, 2025 U.S. Office Action issued in U.S. Appl. No. 18/537,908.

FIG. 9
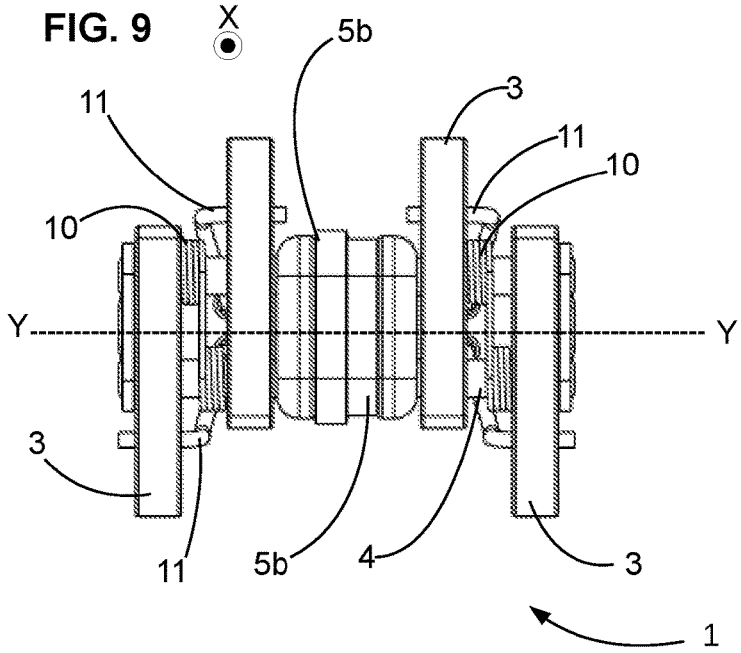
FIG. 11
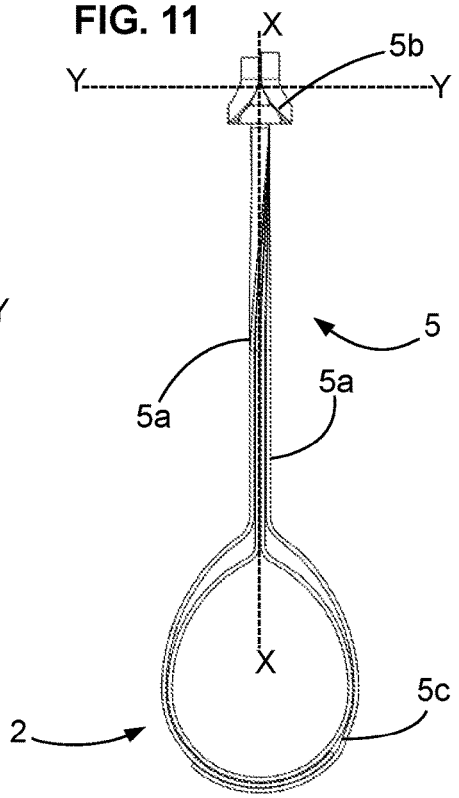
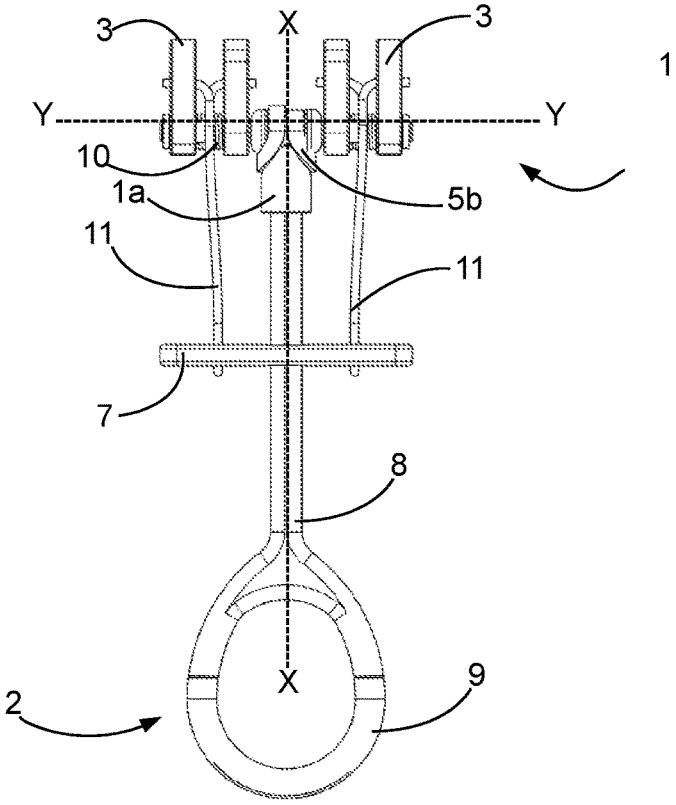
FIG. 10
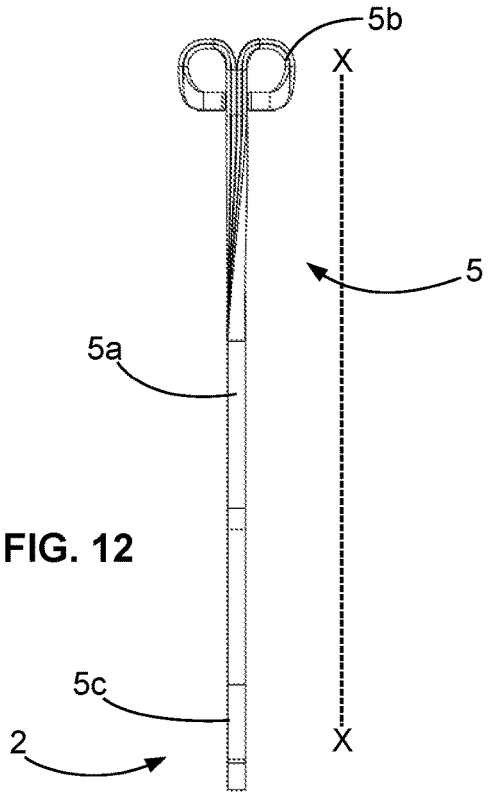
FIG. 12

FIG. 13
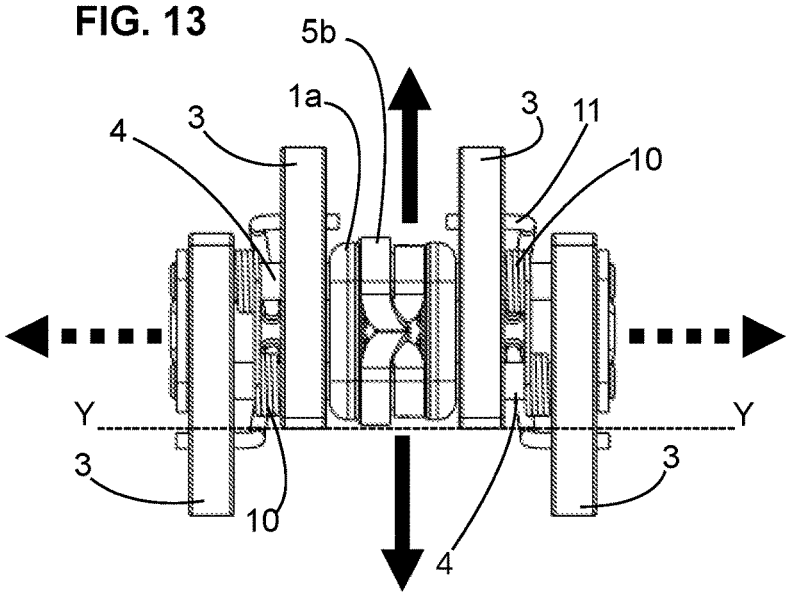
FIG. 14
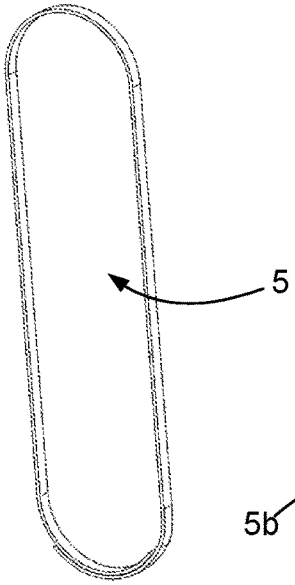
FIG. 15
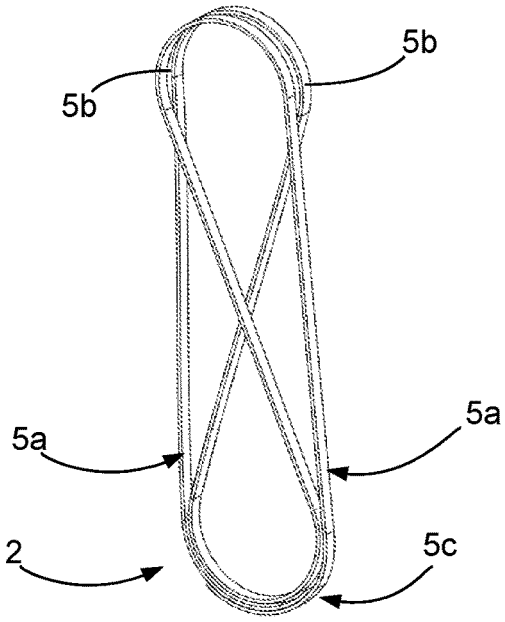
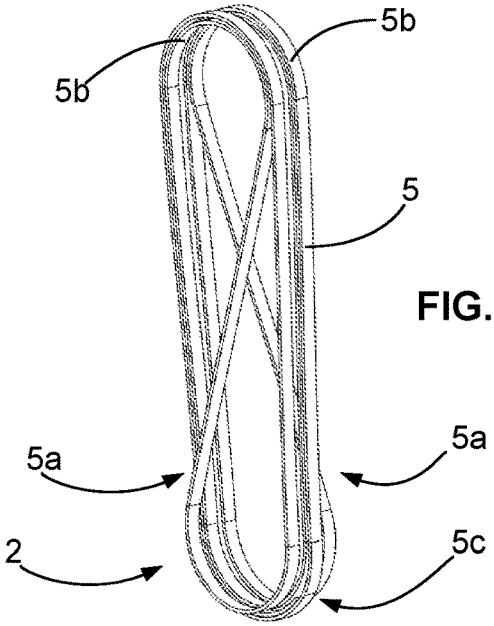
FIG. 16

CAMMING CLAMPING DEVICE, METHOD FOR MANUFACTURING ONE SUCH DEVICE AND METHOD FOR REPLACING A WIRE ELEMENT OF ONE SUCH DEVICE

BACKGROUND OF THE INVENTION

The invention relates to a camming clamping device, to a method for manufacturing a camming clamping device, and to a method for replacing a wire element of a camming clamping device.

PRIOR ART

During the climbing phases, a climber is required to place protection points on a rockface. The climber successively installs several protection points that are designed to support him in case of a fall. Certain rockfaces are equipped with pre-installed protection points, for example in the form of spits that are sealed in the rock. Other rockfaces are not equipped with such points so that the climber has to find the crevice that is most suitable for installing his protection point.

When the climber has to place his/her protection points, it is conventional to install passive chocks and active chocks. The chocks are designed to be inserted in crevices that are generally holes, cracks, channels or any other recess that is deep enough to enable a chock to be inserted. Each particular shape of crevice is suitable for a particular chock configuration. Passive chocks are often formed by metal parts having a specific shape. In a first spatial position, the chock can be inserted in a fault of a rockface and, in a second spatial position, the chock is wedged between two opposite faces. It is then possible to install and remove the chock easily, provided that the latter is placed in the right spatial configuration inside the hole. If this is not the case, in case of a fall, the spatial configuration of the chock will be such that it will be jammed between the two opposite faces of the hole.

In addition to passive chocks, active chocks are also known, also called camming chocks or camming clamping devices. The camming chock is provided with a head having a plurality of cams. The cams are mounted around one or more pivot shafts.

The cams move between a retracted position and an extended position. In the retracted position, the volume occupied by the head is less than in the extended position. The chock head is inserted in a crack in its retracted position and the cams then seek to move to the extended position which presses the cams against the two opposite rockfaces of a crack. The shape of the cams has the effect of increasing the force applied on the faces of the crack when a pull is exerted on the chock.

In conventional manner, at a first end, a camming chock has a head provided with several rotary cams. The second end of the camming chock is an annular end that defines a through hole and that is configured to receive a carabiner and to act as anchor point for the climber.

The head is mechanically connected to the annular end by means of a cable that is generally a steel cable. The two ends of the cable are clamped in the head of the chock by crimping. The cable extends continuously between the two ends along the body and it extends along the annular end so as to ensure the mechanical continuity between the end fixed to the rockface and the end designed to support the climber.

As the cable does not have the transverse rigidity necessary to ensure that placing of the chock is well mastered, it is conventional to provide a rod that extends from the head in the direction of the annular end. The cable passes through the rod.

Finally, actuation of the cams is achieved by means of a trigger that is installed movable slidingly along the rod. When the user pulls on the trigger in the direction of the annular end, the cams move to the retracted position. When the user interrupts this pulling action, a spring returns the cams to the extended position.

A large number of configurations of camming chocks are known describing different configurations of cams, cables, rods or annular ends.

In conventional manner, the cable passes through a hollow rod that extends from the head. The rod is passed through by the cable to ensure the mechanical continuity. An alternative architecture does however exist in which one or more rigid metal rods connect the head to the annular end. It is no longer necessary to use a cable. This alternative configuration is known from the following documents: DE2824654, U.S. Pat. Nos. 4,565,342, 4,575,032, 4,645,149, GB2158540, U.S. Pat. Nos. 4,184,657, 4,513,641, and GB2369068. This infinitely rigid rod configuration is not advantageous as it does not enable the chock to be installed easily in curved fissures.

In conventional manner, the metal cable that extends from one end of the camming chock to the other is U-shaped, its two ends being fixed to the head by crimping whereas the central portion defines the annular end. The documents US2021/0001181 and US2020/034075 illustrate a camming chock the two ends of the metal cable of which are crimped in the head under the pivot shafts of the cams. The documents US2020/034075 and U.S. Pat. No. 4,832,289 also disclose an embodiment in which only one end of the cable is crimped in the head of the chock. The other end is crimped in the annular end. The documents U.S. Pat. Nos. 7,278,618 and 6,679,466 disclose a cable each end of which is crimped independently on each side of the cams. An end-piece defining a hole is crimped to each end and the hole of the end-piece receives a shaft which secures the cable with the head.

The documents U.S. Pat. No. 5,860,629 and GB2380949 disclose a cable one end of which is crimped in the head of the chock and the other end of which receives an end-piece forming the annular end. The end-piece is crimped on the cable.

The document U.S. Pat. No. 6,679,466 illustrates a camming chock in which the two ends of the metal cable each pass round an anchoring shaft of the head. The two ends form a cable loop which is crimped to ensure the mechanical continuity along the camming chock.

When the climber ascends a rockface, he/she knows or anticipates the number of chocks to use and the dimensions of the chocks to take with him/her. It is not rare for a climber to start out with fifteen or so chocks which can represent a considerable weight. New configurations of chocks are therefore sought for enabling a gain in weight to be achieved.

In order to provide a lighter product, it is proposed to replace the steel cable by a Dyneema® strap. The two ends of the strap are fixed in the head and the strap extends along the chock to define the annular end. A first technical solution has been proposed in the document US 2004/0035992. This document discloses two pairs of cams mounted rotating around a single pivot shaft. The pivot shaft passes through a through aperture of a rigid rod. An activation trigger of the cams is installed slidingly along the rod. A textile strap passes through the rod and the pivot shaft passes through the strap so that the strap provides the mechanical continuity between the cams and a carabiner fixed in the ring at the opposite end of the rod. This configuration is not practical in use as the strap inconveniences the user. Maintenance of the attachment device is more difficult and it is almost impossible to replace the strap as it is necessary to dismantle the head.

Another technical solution is delivered in the document U.S. Pat. No. 10,143,892 that proposes to form a ring in a Dyneema® cord by means of a splicing step. The cord passes through the rod and springs before a splicing step is performed which forms the ring. The portion of the ring that is salient from the rod is passed through by an anchoring shaft installed in immediate proximity to the pivot shafts of the cams. The splicing step is a long and costly step the complexity of which is increased by insertion of the elements of the rod before closing the ring. Passing the shaft through the ring also appears complicated to perform. This chock configuration remains expensive. It is also apparent that replacement of the loop formed by splicing is almost impossible.

Object of the Invention

One object of the invention consists in providing a camming clamping device with a mechanical connection between the head and the annular end that is more efficient and that is potentially easier to manufacture than the configurations of the prior art.

According to one feature of the invention, the camming clamping device comprises:

- a head having at least one cam, at least one pivot shaft, and at least one spring, the at least one cam being mounted movable swivelling around the at least one pivot shaft, the at least one cam being movable between a retracted position and an extended position, the at least one spring being functionally coupled to the at least one cam to bias the at least one cam to the extended position;
- an annular end mechanically coupled to the head, the annular end delineating a through hole;
- at least one wire element mechanically connecting the head and the annular end, the at least one wire element being in the form of a ring;
- an actuating system coupled to the at least one cam, the actuating system being configured to selectively engage the retracted position, the actuating system having a trigger installed slidingly along a first direction connecting the head and the annular end.

The camming chock is remarkable in that the ring is folded to define at least two legs each comprising a top end, a bottom end and two strands, in that the two strands join up in the top end to form a loop attached to the head, in that the bottom end of each leg is extended by a connecting portion, the connecting portion connecting the legs to one another, the connecting portion delineating said through hole, the connecting portion comprising at least four strands of the wire element.

In advantageous manner, the ring of wire element is a ring made from textile material.

In a particular configuration, each loop is installed sliding with respect to the head.

In one development, each strand of the connecting portion is installed sliding with respect to the others.

Preferentially, the ring of wire element is obtained by stitching two terminations of the wire element on one another, the seam being located in the connecting area.

According to one embodiment, the camming clamping device comprises a rod extending from the head up to the annular end. The rod is hollow and passed through by the same number of strands as in the connecting portion.

In an advantageous development, the rod is adjustable in length in the first direction.

Preferentially, each loop is attached to at least one anchor point installed in removable manner with respect to the head.

In another advantageous development, one anchor point passes through at least two loops.

Preferentially, the removable anchor point is located at a distance from at least one pivot shaft, between the at least one pivot shaft and the annular end in the first direction.

In advantageous manner, the head has a body supporting the at least one pivot shaft. Each loop passes round the at least one pivot shaft to attach the wire element with the head. The head is pass-through to let the loops pass.

In a preferential development, the head has a body supporting the at least one pivot shaft, the body being pass-through to let the loops pass. The loops each form a cow hitch throttling the body to secure the wire element with the head.

It is a further object of the invention to provide a method for manufacturing a camming clamping device that is easier to perform than the configurations of the prior art.

This result tends to be achieved by means of a method for manufacturing comprising the following steps:

- providing a head having at least one cam, at least one pivot shaft, and at least one spring, the at least one cam being installed movable swivelling around the at least one pivot shaft, the at least one cam being movable between a retracted position and an extended position, the at least one spring being functionally coupled to the at least one cam to bias the at least one cam to the extended position;
- providing an actuating system coupled to the at least one cam, the actuating system being configured to selectively engage the retracted position, the actuating system having a trigger installed slidingly along a first direction connecting the head and the annular end;
- providing at least one wire element in the form of a ring, the ring being folded to define at least two legs each comprising a top end, a bottom end and two strands, wherein the two strands join up in the top end to form a loop, wherein the bottom end of each leg is extended by a connecting portion, the connecting portion connecting the legs to one another, the connecting portion at least partially forming an annular end delineating a through hole, the connecting portion comprising at least four strands of the wire element;
- attaching the loops to the head to mechanically couple the annular end with the head, the at least one wire element mechanically connecting the head and the annular end.

It is a further object of the invention to provide a method for replacing a wire element of a camming clamping device that is easier to manufacture than in the configurations of the prior art.

This result tends to be achieved by means of a method for replacing a wire element of a camming clamping device comprising the following steps:

- providing a camming clamping device according to any one of the foregoing configurations;
- removing the wire element connecting the head and the annular end;
- providing a new wire element in the form of a ring;
- folding the ring to define at least two legs each comprising a top end, a bottom end and two strands, the two strands joining one another in the top end to form a loop and wherein the bottom end of each leg is extended by a connecting portion, the connecting portion connecting the legs to one another, the connecting portion delineating the through hole of the annular end, the connecting portion comprising at least four strands of the wire element;

attaching the loops to the head to mechanically couple the annular end with the head, the at least one wire element mechanically connecting the head and the annular end.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which:

FIG. 9 schematically illustrates a top view of the head of the camming clamping device according to the second embodiment;

FIG. 10 schematically illustrates a front view of a camming clamping device according to a third embodiment;

FIG. 11 schematically illustrates a front view of the wire element in its arrangement inside the camming clamping device according to the third embodiment;

FIG. 12 schematically illustrates a side view of the wire element in its arrangement inside the camming clamping device according to the third embodiment;

FIG. 13 schematically illustrates a top view of the head of the camming clamping device according to the third embodiment;

FIG. 14 schematically illustrates a perspective view of a ring of wire element designed to connect the head and the annular end of the camming clamping device before the ring is folded;

FIG. 15 schematically illustrates a perspective view of a ring of wire element folded so that two pairs of two strands are designed to connect the head and the annular end of the camming clamping device;

FIG. 16 schematically illustrates a perspective view of a ring of wire element folded so that four pairs of two strands are designed to connect the head and the annular end of the camming clamping device.

DESCRIPTION OF THE EMBODIMENTS

Figure 1:
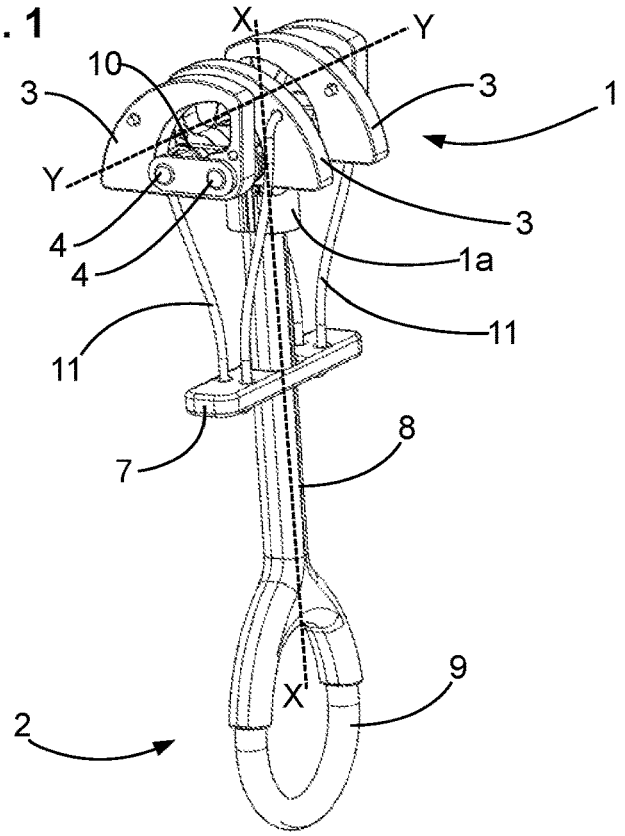
FIG. 1 schematically illustrates a perspective view of a camming clamping device according to a first embodiment.

FIGS. 1 to 16 illustrate different embodiments of a camming clamping device also known under the designation of "camming clamp". The camming clamping device is an active clamping device.

The camming clamping device comprises a first end that is a head 1 and an opposite second end that is an annular end 2. The head 1 has at least one cam 3 and preferably several cams 3 that are installed movable swivelling between an extended position and a retracted position. The cam or cams 3 are installed movable around at least one pivot shaft 4 of the head 1. The cam or cams 3 are mechanically coupled to a body 1*a* of the head 1. The pivot shaft 4 is fixed to the body 1*a* of the head 1. The body 1*a* can be formed by one or more parts. The at least one cam 3 is installed swivelling with respect to the body 1*a*. The pivot shaft 4 extends mainly in a second direction YY that is perpendicular or substantially perpendicular to the first direction XX.

In conventional manner, the annular end 2 is in the form of a ring that defines a through hole configured to receive a carabiner. The annular end 2 is able to support the weight of a user.

The camming clamping device has a wire element 5 that mechanically connects the head 1 with the annular end 2. The wire element 5 extends continuously from the head 1 up to the annular end 2 in a first direction XX. The wire element 5 is attached to the head 1 at each of its ends and extends along the annular end 2 between the anchorages thereof with the head 1. The wire element 5 ensures the mechanical continuity between the head 1 and the annular end 2. The wire element 5 couples the cams 3 mechanically with the annular end 2 so that a user attached to the annular end 2 is retained by means of the cams 3 wedged for example in a crack.

The clamping device comprises an actuating system coupled to the at least one cam 3. The actuating system is configured to selectively engage the retracted position of the at least one cam 3. The actuating system has a trigger 7 installed slidingly in the first direction XX connecting the head 1 and the annular end 2. In other words, the trigger 7 is installed movable with respect to the head 1 and is coupled to the at least one cam 3. When the trigger 7 is outside a first position, the at least one cam 3 is outside the extended position.

Preferentially, the trigger 7 is coupled to the at least one cam 3 so that movement of the trigger 7 away from the head 1 results in movement of the at least one cam 3 out of the extended position, i.e. to the retracted position. In preferential manner, the trigger 7 is coupled to all the cams 3 so that movement of the trigger 7 away from the head 1 results in movement of the cams 3 to the retracted position.

It is advantageous for movement of the trigger 7 in the direction of the head 1 not to impose any movement of the cam 3 and in particular not to impose movement of the cam 3 to the extended position.

In a preferential embodiment, the trigger 7 is installed slidingly along the wire element 5 between the head 1 and the annular end 2. The trigger 7 can be coupled to the cam 3 or to each cam 3 by an additional wire element 11. The additional wire element 11 can be a metal cable, a textile element or a wire element made from synthetic material, for example from plastic. The additional wire element 11 couples the cam 3 to the trigger 7 and enables a movement of the trigger 7 towards the annular end 2 to be transcribed into a movement of the cam 3 to the retracted position.

The camming clamping device has a spring 10 that is configured to bias the at least one cam 3 to the extended position. The spring 10 can be manufactured in any technology: it can be a coil spring operating in traction, in compression, in torsion or in flexion. It can also be a blade or a metal wire that is deformed flexibly. In the absence of any stress and of any obstacle, the spring 10 places the cam or cams 3 in the extended position. The force applied on the trigger 7 to move away from the head 1 corresponds to a force applied on the spring 10 to move the cam or cams 3 to the retracted position. In one embodiment, the spring 10 is fixed on the one hand to the cam 3 and on the other hand to the head 1. In another embodiment, the spring 10 is fixed on the one hand to a first cam 3 and on the other hand part to a second cam 3 mounted on another pivot shaft 4 than the first cam 3. The clamping device can comprise as many springs 10 as cams or as many springs 10 as pairs of cams 3.

In preferential manner, the camming clamping device comprises at least one rod 8 that extends from the head 1 in the direction of the annular end 2, i.e. in the first direction XX. In the embodiments illustrated in FIGS. 1 to 13, the camming clamping device comprises a single rod 8 that extends longitudinally in the first direction XX. In preferential manner, the rod 8 is pressing firmly against the head 1 or is fixed to the head. Advantageously, the rod 8 partially defines the through hole of the annular end 2.

The rod 8 is hollow and is passed through by the wire element 5 to connect the annular end 2 with the head 1. In preferential manner, the rod 8 is more rigid than the wire element 5 perpendicularly to the XX direction which enables the camming clamping device to be securedly held by means of the rod 8 and the clamping device to be placed precisely in a crack in comparison with an equivalent device without the rod 8. In preferential manner, the rod 8 extends continuously from the head 1 up to the annular end 2 so as to provide a good mechanical strength when the clamping device is held by annular ring 2 and the trigger 7. It is advantageous for the trigger 7 to be installed slidingly along the rod 8 and for the rod 8 to separate the wire element 5 and the trigger 7. The rod 8 enables the wire element 5 to be protected outside the head 1 up to the annular end 2.

As illustrated in FIG. 14, the wire element 5 is in the form of a ring, preferably a ring made from textile material. The ring is formed by a strand, a first end of which is fixed to an opposite second end. It is advantageous for the ring to be closed by stitching. The two ends of the wire element 5 are secured fixedly on one another by a stitching area. Stitching is a well-mastered process which makes it easy to obtain a ring with a well-mastered tensile strength. The use of a stitching step enables a ring to be formed that is less costly and the dimension of which is better mastered than its equivalent obtained by splicing. It is advantageous for the ring to be devoid of crimping and splicing. The wire element 5 can be a strap or a rope.

The ring made from textile material can be a polyethylene ring of very high molar mass, for example made from a material marketed under the tradenames Dyneema® or Spectra®.

FIG. 14 illustrates a wire element 5 in the form of a ring. As illustrated in FIGS. 15 and 16, the ring is folded to define at least two legs 5*a* each comprising a top end and a bottom end. Each leg 5*a* comprises two strands. The two strands join one another in the top end to form a loop 5*b*. The loop 5*b* is designed to be attached to the head 1. The bottom end of each leg 5*a* is extended by a connecting portion 5*c*. The connecting portion 5*c* connects the legs 5*a* to one another. The connecting portion 5*c* delineates the through hole of the annular end 2.

The strands of each leg 5*a* are extended on one side or the other to form a loop 5*b* or a connecting portion 5*c*. A loop 5*b* extends one strand by another strand of the same leg 5*a*. The connecting portion 5*c* extends a strand by a strand of another leg 5*a*. In other words, each strand connects one end of a loop 5*b* with the connecting portion 5*c*. The connecting portion 5*c* comprises at least four strands of the wire element 5. Connecting portion 5 comprises twice as many strands as loops 5*b*. Preferentially, each strand of the connecting portion 5*c* is installed sliding with respect to the others.

FIG. 15 illustrates the wire element 5 folded so as to define a U-shape with two legs 5*a* connected by a connecting portion 5*c*. The two legs 5*a* are terminated by a loop 5*b* at the opposite end to the connecting portion 5*c*. The two legs 5*a* are deformed for the loops 5*b* to be facing one another to define a through hole.

As illustrated in FIGS. 3, 4, 7, 8, 11 and 12, the wire element 5 is in the form of a ring that is folded and shaped to form a U-shape. The two legs 5*a* are close to one another whereas the connecting portion 5*c* defines a ring with a through hole to define the annular end 2 of the clamping device. When the loops 5*b* are attached to an anchorage, application of a force on connecting area 5*c* has the effect of stressing the multiple strands that connect connecting area 5*c* and the anchorages. The wire element 5 ensures the tensile strength.

The loops 5*b* are fixed to the head 1 and the connecting portion 5*c* delineates the through hole of the annular end 2. The strands of the wire element 5 ensure the mechanical continuity between the head 1 and the annular end 2. This embodiment is particularly advantageous as attachment of the head 1 with the wire element 5 is performed using the loops 5*b*. It is not necessary to fix the wire element 5 to the head 1 with a knot, a splicing step, stitching, crimping or any other technological step modifying the mechanical integrity of the wire element 5.

The wire element 5 at least partially delineates the through hole of the annular end 2 by means of the connecting portion 5*c* thereby avoiding a specific loop having to be formed by a knot, a splicing step, stitching, crimping or any other technological step modifying the mechanical integrity of the wire element 5. In order to protect the wire element 5, in the annular end 2, the rod 8 can be formed by several parts. The wire element 5 can pass through a stiffener 9 that advantageously comes into contact with the main portion of the rod 8 to prevent access to the wire element 5. The use of a rod formed in at least two parts makes installation of the wire element in the rod 8 easier to perform. The wire element 5 in the form of a ring is folded to define the legs 5*a*, the loops 5*b* and the connecting portion 5*c*. The wire element 5 passes through the stiffener 9 so that the stiffener 9 covers the connecting portion 5*c*. Legs exit from the stiffener via the two ends. The two legs are inserted via one end of the main portion of the rod 8 until they exit via the top end designed to be inserted in the head 1. The loops 5*b* exit from the rod 8. The loops 5*b* are attached to the head 1. This embodiment is advantageous as the main portion of the rod can only define a single through hole in the XX direction. As an alternative, the main portion and the stiffener can be irremovable. The stiffener defines a through hole each end of which opens into the main portion that has a common hole or a specific hole. This embodiment is less advantageous as the wire element is less easy to install. It is further possible to provide other configurations of rods made in several parts, but they appear less advantageous as regards the mechanical strength, ease of use and/or manufacturing cost.

The wire element 5 has at least two loops 5*b* attached to the head 1, i.e. attached directly to the head 1, and connected by strands that extend continuously along the rod 8 and delineate the through hole of the annular end 2. The wire element 5 which is annular ensures the mechanical continuity of the clamping device. This technical solution is more advantageous than the one presented in the document U.S. Pat. No. 10,143,892 which uses a splicing step to form a loop after the rod has been installed.

FIG. 16 illustrates another type of folding of the wire element 5 into the shape of a ring. The head 1 and the annular end 2 are connected by more than four strands of the wire element 5. In the illustrated configuration, the head 1 and the annular end 2 are connected by eight strands. The wire element defines four legs 5*a* formed by two strands and therefore one loop each. Other arrangements are possible.

To ensure a good strength, the ring is preferentially devoid of a knot in the legs 5*a* and/or in the head 1. The loops 5*b* are extended at their ends by strands that come from or extend up to the annular end 2 and not by a knot formed at the end of the wire element 5.

FIGS. 3, 4, 7, 8, 11, 12 and 15 illustrate a ring that is folded once to form four strands of the wire element 5 connecting the annular end 2 and the head 1. Different types of folding are usable for the ring of wire element 5 to define a connecting area 5*c* able to at least delineate the annular end 2 and to extend at least two legs 5*a* designed to extend up to the head 1 and terminated by the loops 5*b* to be fixed to the head 1.

At least four strands of the wire element 5 pass through the rod 8 between the head 1 and the annular end 2. The four strands are in mechanical continuity by means of connecting area 5*c* and the loops 5*b*. The connecting portion 5*c* ensures the mechanical continuity between the legs 5*a*. Preferentially, the seam is located in the connecting portion 5*c* in order to limit the volume occupation of the head 1 or close to the head 1.

Each loop 5*b* present in the head 1 is fixed to the head 1. Preferably, each anchorage between a loop 5*b* and the head 1 allows sliding of the wire element 5 with respect to the head 1. When the wire element 5 is tensioned, the tensile forces balance out between the strands due to sliding of the loops 5*b*. Preferably, the connecting portion 5*c* allows sliding of the different strands with respect to one another to make it easier to balance the forces.

Application of a tensile stress between the head 1 and the annular end 2 has the effect of tensioning the wire element 5 and in particular the at least four strands of the wire element 5 connecting the head 1 to the annular end 2. Increasing the number of strands enables a better trade-off to be had between tensile strength in the XX direction, space occupation inside the rod 8 and flexibility perpendicularly to the XX direction.

The document US 2004/0035992 uses a strap loop that is installed flexible in a hollow rod. The maximum length of the loop corresponds substantially to half the length of the strap. When the loop is manufactured, a difference exists as regards the cut length of the strap and the length/position of the seam with respect to the required value. When several loops are manufactured, this results in dispersion of the length of the loop around a target value. Pending use, the camming clamping device is hung by the strap. The discrepancies on the length of the loop result in the camming clamping devices not being as identical and interchangeable as expected, which may complicate extraction of the camming clamping device. The use of a wire element folded to form a U-shape has the effect of dividing at least by two the final result of the manufacturing uncertainty on the final length between the anchorage with the head and the annular end.

The document U.S. Pat. No. 10,143,892 uses a single ring made from textile material formed by splicing. There again, in comparison with the prior art, the use of a wire element folded to form a U-shape has the effect of dividing the final result of the manufacturing uncertainty on the final length between the anchorage with the head and the annular end by two. It is also important to emphasize that the splicing step is long and costly in comparison with fixing by a single seam where the two strands are arranged on one another and not in one another, i.e. without splicing.

In FIGS. 3, 4, 7, 8, 11 and 12, the legs 5*a* are deformed by an angle equal to 90% so that the through hole defined by the loops 5*b* is offset by 90° with respect to the through hole defined by the connecting portion 5*c*. The offset angle can be represented by the angle that exists between the median cutting planes of observation of a ring. The angular offset is a pivoting around the XX axis.

Different embodiments are possible to secure the loops 5*b* of the wire element 5 with the head 1.

In a particular embodiment, the head 1 has at least one anchorage 6, for example an anchoring shaft. The loops 5*b* are attached to the at least one anchorage 6 to achieve the mechanical continuity between the head 1 and the wire element 5. Preferentially, the wire element 5 passes round the anchorage 6 to achieve the mechanical continuity with the annular end 2. More preferentially, the loop 5*b* throttles the anchorage 6 to achieve the mechanical continuity.

In the embodiments illustrated in FIGS. 1 to 13, different configurations of attachment of the wire element 5 to the head 1 are illustrated.

FIGS. 2 to 9 illustrate embodiments where the loops 5*b* extending the legs 5*a* form two offset parallel planes. The loops 5*b* are installed facing one another in a direction perpendicular to the parallel planes to form a through hole. An anchorage 6 of the head 1 passes through the loops 5*b* to secure the wire element 5 with the head 1. A configuration with two loops 5*b* or more than two loops 5*b* is possible.

FIGS. 2 to 5 illustrate an embodiment wherein the loops 5*b* present at the ends of the legs 5*a* of the ring are installed facing one another in a direction perpendicular to the first direction XX. An anchoring shaft passes through the two loops 5*b* in the direction perpendicular to the first direction XX. The anchoring shaft is fixed to body 1. In preferential manner, the anchoring shaft is different from the pivot shaft or shafts 4 of the at least one cam 3.

It is particularly advantageous to have an anchorage 6 installed removable with respect to the head 1*a* so as to have a wire element 5 that is easily replaceable. Removal of the anchorage 6 eliminates the attachment between the wire element 5 and the head 1 thereby enabling the wire element 5 to be replaced.

In preferential manner, the anchorage 6 is detachable with respect to the head 1 preferentially without interaction with the pivot shaft or shafts 4 of the at least one cam 3. In another embodiment, the anchorage 6 is destructible independently from the pivot shaft or shafts 4 of the at least one cam 3. This enables replacement of the wire element 5 to be performed by acting on the anchorage 6 without interacting with the pivot shafts 4 of the at least one cam 3 and therefore limiting the interactions liable to modify the movement of the at least one cam 3 with respect to the rest of the head 1. To facilitate attachment to the anchorage 6, it is advantageous for the anchorage 6 to be arranged between the pivot shafts 4 of the at least one cam 3 and the annular end 2.

It is advantageous for the anchorage 6 to be an anchoring shaft, i.e. a rod that is inserted in the body 1*a* to secure the loops 5*b*. The anchoring shaft advantageously has a circular cross-section and advantageously a smooth surface.

For example, the anchoring shaft is fixed to the body 1*a* of the head 1 by screw-fastening, crimping, or riveting. The anchoring shaft extends mainly in a direction perpendicular to the first direction XX.

Figure 2:
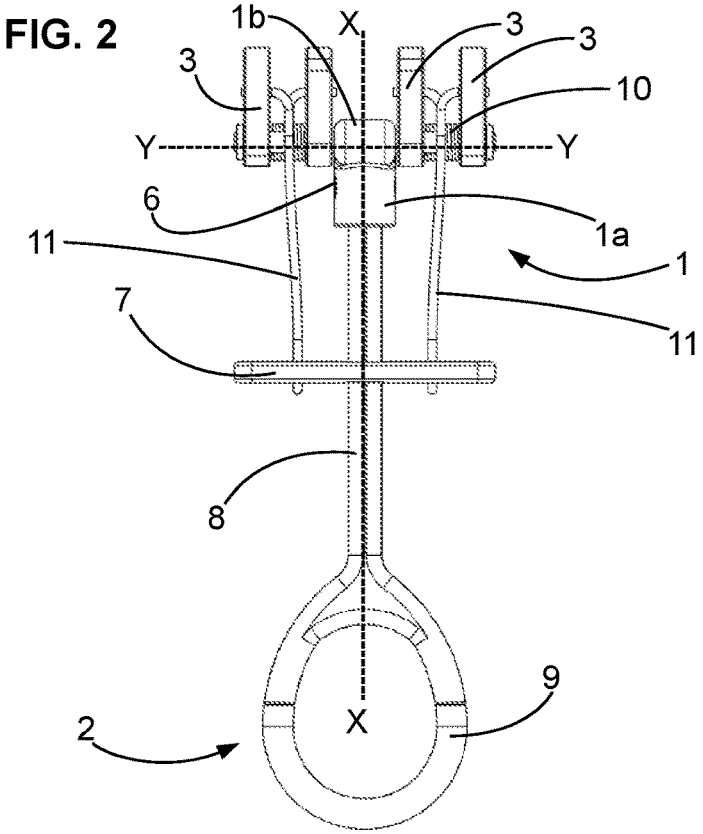
FIG. 2 schematically illustrates a front view of a camming clamping device according to a first embodiment.
Figure 3:
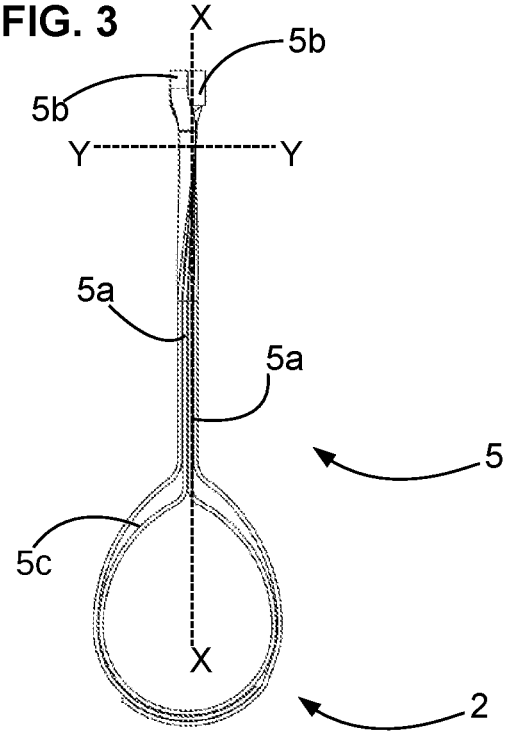
FIG. 3 schematically illustrates a front view of the wire element in its arrangement inside the camming clamping device according to FIGS. 1 and 2.
Figure 4:
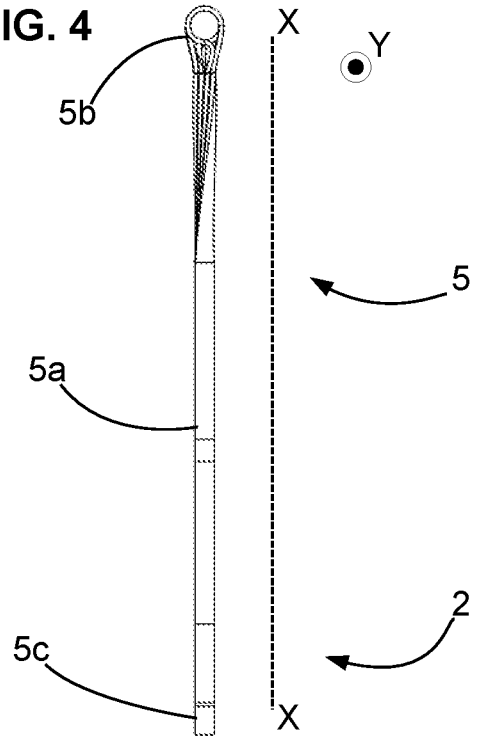
FIG. 4 schematically illustrates a side view of the wire element in its arrangement inside the camming clamping device according to FIGS. 1 and 2.
Figure 5:
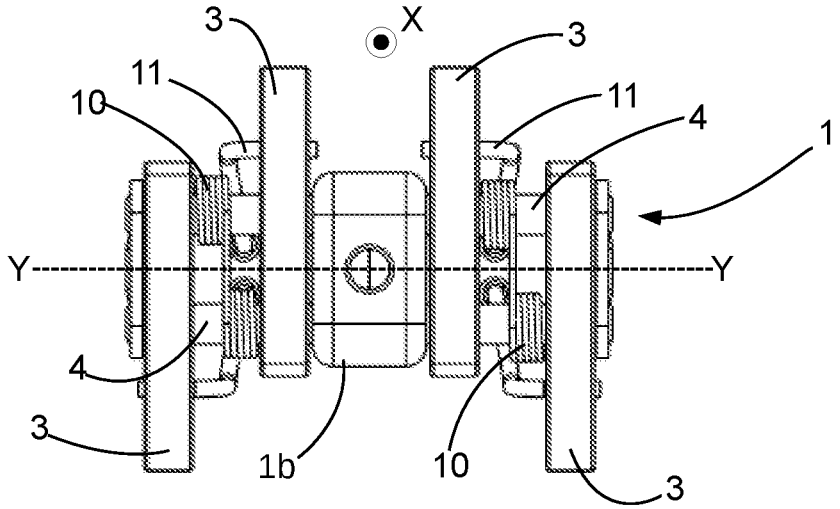
FIG. 5 schematically illustrates a top view of the head of the camming clamping device according to the first embodiment.

In this embodiment, it is advantageous to have a head 1 that defines a blind hole to prevent the wire element 5 from passing through the head 1 in the first direction XX as illustrated in FIG. 2. The head 1 can be capped by a cover 1*b* fitted removable with respect to the body 1*a* thereby enabling access to be had to the loops 5*b* to check the wear of the wire element 5. This also makes it easier to perform installation of the loops 5*b* in the head 1, for example centring with respect to the anchoring shaft when installation is performed.

When the wire element 5 is installed, the loops 5*b* extending the legs 5*a* of the wire element 5 are inserted in the head 1. The anchoring shaft passes through the loops 5*b* and is fixed to the body 1*a* of the head 1 to achieve the mechanical continuity between the head 1 and the annular end 2.

In a particular embodiment illustrated in FIG. 2, the body 1*a* defines hole and the anchorage 6 is inserted in the body 1*a* in a direction perpendicular to the first direction XX, for example the YY direction.

To replace the wire element 5, the anchorage 6 is removed and a pull is exerted on the wire element 5 in the first direction XX. According to the specific case, the rod 8 is kept or the rod 8 is replaced. A new wire element 5 is installed through rod with the loops 5*b* that are inserted in the head 1. The anchorage 6 or a new anchorage 6 passes through the loops 5*b* and is fixed to the head 1 to attach the wire element 5 with the head 1.

Replacement of the wire element 5 is easy and does not require any action on the cams 3, the pivot shaft or shafts 4 or on the trigger 7.

In an alternative embodiment, the head 1 has a body 1*a* and the pivot shafts 4 are fixed to the body 1*a*. The head 1 also has a cover 1*b* installed removable with respect to the body 1*a*. The loops 5*b* are fixed directly to the cover 1*b*. For example, the cover 1*b* can be provided with hooks receiving the loops 5*b*. The anchorage is formed by hooks of the cover 1*b*.

In another alternative, the anchorage 6 is installed removable from the head 1 in the first direction XX. When the cover 1*b* is fixed to the body 1*a*, the anchorage 6 is irremovable. When the cover 1*b* is removed, it is possible to remove the anchorage 6 to install or remove the loops 5*b*. The body 1*a* defines a housing for the anchorage 6 and the cover 1*b* encloses the anchorage 6 in the housing. The anchorage 6 can be a rod securedly held at its two ends by the body 1*a* that forms an end-of-travel stop in the XX direction in the direction of the annular end 2.

Figure 6:
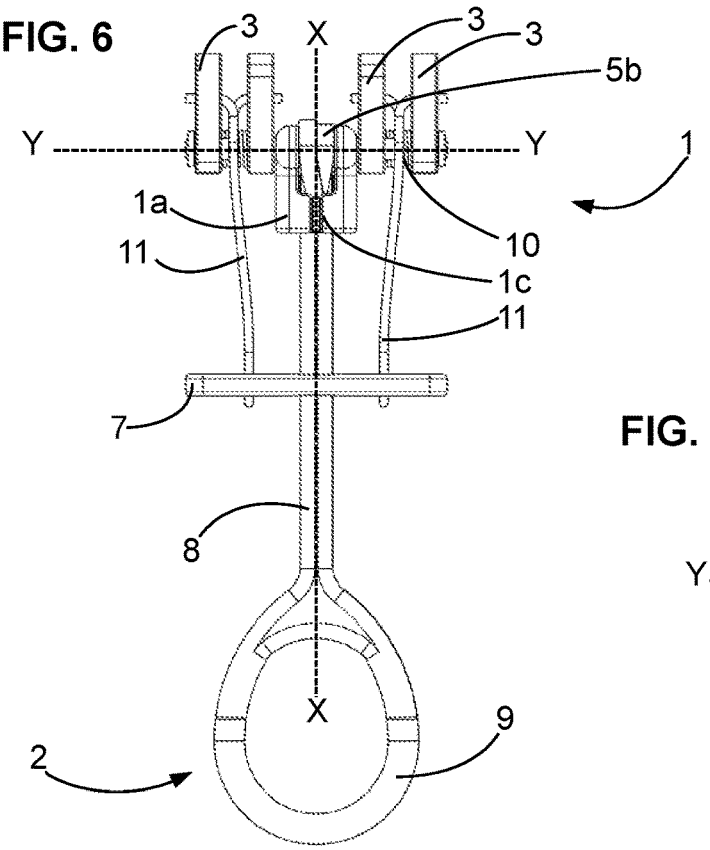
FIG. 6 schematically illustrates a front view of a camming clamping device according to a second embodiment.
Figure 7:
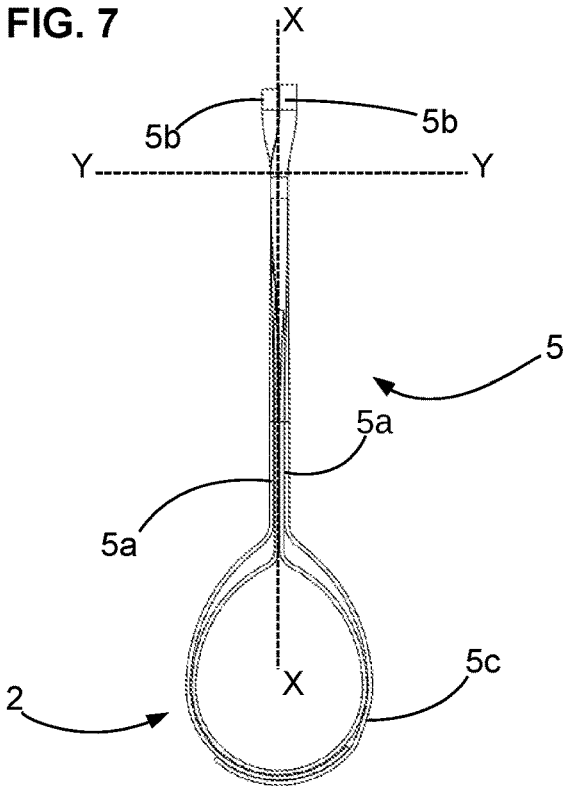
FIG. 7 schematically illustrates a front view of the wire element in its arrangement inside the camming clamping device according to the second embodiment.
Figure 8:
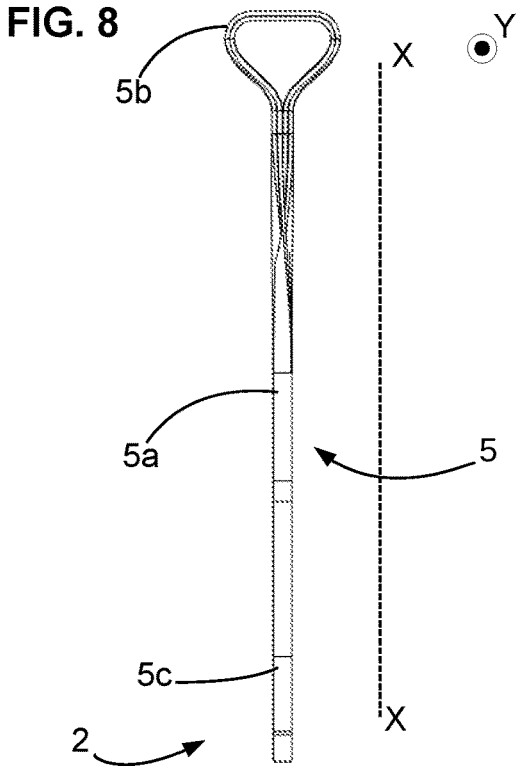
FIG. 8 schematically illustrates a side view of the wire element in its arrangement inside the camming clamping device according to the second embodiment.

In an alternative embodiment, the loops 5*b* can leave the head 1 to pass round one or more pivot shafts 4 and be attached to an anchorage 6 fixed to the head 1. Each loop 5*b* can be fixed to a specific the anchorage 6 or all the loops 5*b* can be attached to the same anchorage 6 which makes for a gain in compactness. FIG. 6 can represent a side view of such an embodiment with a loop 5*b* that exits from one side of the head 1 and is fixed to a substantially identical anchorage 6 to the one illustrated in FIG. 2.

These embodiments are advantageous as they make it possible to use the loops 5*b* of reduced size. Securing of the wire element 5 on the head 1 involves a small length of slack to perform attachment on the head 1. The variation of length can be easily absorbed by a rod 8 that is deformable in the XX direction, for example with a deformable stiffener 9 or any other suitable means.

In another embodiment, the legs 5*a* pass through the rod 8 and escape from the head 1. In this alternative embodiment illustrated in FIGS. 6 to 9, the loops 5*b* extending the legs 5*a* are passed through by the at least one pivot shaft 4 of the at least one cam 3. Preferably, the loops 5*b* are passed through by all the pivot shafts 4 of the cams 3.

Such a configuration can be obtained by dismantling the pivot shafts 4 to insert the latter in the loops 5*b*. As an alternative, the pivot shafts 4 with the cams 3 are inserted in the loops 5*b*. Additional wire elements 11 that connect the cams 3 to the trigger 7 are dismountable to be removed and then reinstalled so that the loops 5*b* surround the pivot shafts 4 without interacting with the actuating system of the cams 3. Preferentially, either the connection between the additional wire element 11 and the cam 3 is removable or the connection between the additional wire element 11 and the trigger 7 is removable. As an alternative, the trigger 7 is divisible.

Advantageously, the head 1 defines two opposite slots 1*c* in a direction perpendicular to the first direction XX and perpendicular to the second direction YY. The head 1 is split in the XX direction. The slot 1*c* enables a strand of the wire element 5 to pass through. The loops 5*b* leave the rod 8 and move away from one another in the YY direction. The assembly formed by the pivot shafts 4 and the cams 3 passes through the two straps 5*b*. The straps move towards one another to come back into the alignment of the rod 8. The strands pass through the slots 1*c*. The connection between the cams 3 and the trigger 7 is re-established. The loops 5*b* surround the pivot shafts 4 ensuring the mechanical continuity between the head 1 and the annular end 2. In preferential manner, body 1*b* is interposed between the loop 5*b* and the pivot shaft 4 to avoid a direct contact between the wire element 5 and the pivot shaft 4. This avoids having to modify the behaviour of the pivot shafts 4 according to the tension present in the wire element 5.

FIG. 9 illustrates, in top view, the routing of the strands defining two loops 5*b* that pass round two pivot shafts 4 and that are arranged between the pairs of cams 3 in the YY direction.

In the embodiment illustrated in FIGS. 10 to 13, the legs 5*a* extend outside the head 1, for example in the top of the head 1 in the XX direction in opposite manner to the annular end 2. The loops 5*b* are arranged to each form a cow hitch throttling the body 1*a* and possibly one or more pivot shafts 4.

To form the cow hitch, the loop 5*b* exits from the head 1 in the direction away from the annular end 2. Then the annular end 2 passes through the loop 5*b*. By pulling on the annular end 2, the cow hitch is formed throttling the body 1*a* and ensuring the mechanical continuity between the head 1 and the annular end 2. In the embodiment illustrated in FIGS. 10 to 13, the two loops 5*b* exit from the head and follow opposite paths to throttle the body 1*a*. The directions on exit from the head are illustrated in FIG. 13 by the bold arrows. FIGS. 11 and 12 represent the shape of the wire element 5 according to two different views in the configuration of FIG. 10. Each loop 5 exits from the head 1 on the opposite side to the annular end 2 before being passed through by the annular end 2. In preferential manner, each loop 5*b* passes round one or more pivot shafts 4 before being passed through by the annular end 2. The cow hitch surrounds one or more pivot shafts 4.

To obtain a substantially equivalent result, the direction taken can be that of the dotted arrows, i.e. with an angular offset equal to 90° around the XX direction. It is necessary to provide a removable trigger or a removable additional wire element 11 with respect to the trigger or with respect to the cams 3.

In advantageous manner, the clamping device comprises two pivot shafts 4 and the loops 5*b* exit from the body 1*a* passing between the two pivot shafts 4 as illustrated in FIG. 13.

In a particular embodiment, the rod 8 has an adjustable length in the XX direction. Adjustment of the length enables an increased length of the wire element 5 to be provided with respect to the rod 8 in the assembly phase, for example to form the cow hitch or to pass round the cams 3. Once the loops 5*b* have been attached to the head 1, the length of the rod 8 is increased to absorb the excess of the wire element 5. This makes for a better ergonomy between the head 1 and the annular end 2 without modifying the tensile strength between the head 1 and the annular end 2.

The adjustable-length rod 8 can be a telescopic rod. However, other embodiments are possible.

The embodiment illustrated in the figures makes removal easy to change at least the one of the following components: the wire element 5 or the rod 8. In an advantageous embodiment, the rod 8 is removable with respect to the head 1 which enables the rod 8 to be replaced when the latter is damaged.

It is further possible to replace the rod 8 and the wire element 5 to adjust the length of the clamping device to a specific requirement. An extender of the trigger 7 can then be envisaged if the length of the rod 8 and of the wire element 5 is considerably increased.

In a particular embodiment, the rod 8 has a tapered end facilitating formation of a sizeable ring in the annular end 2.

The rod 8 is preferentially made from a polymer material so as to be able to flexible in one or more directions perpendicular to the first direction XX.

In the illustrated embodiments, the camming clamping device presents four cams 3. It is possible to use more or less cams 3. The configurations illustrated for installation of the wire element 5 are applicable on clamping devices that comprise one, two, three, four or more cams 3. The number of cams 3 can be even or odd. The cams 3 are preferentially made from metal, for example from aluminium alloy or steel.

The embodiments illustrated in FIGS. 1 to 13 are particularly advantageous as they enable the wire element 5 providing the mechanical continuity between the head 1 and the annular end 2 to be replaced without having to dismantle the assembly formed by the body 1*a*, the pivot shafts 4 and the cams 3. This enables safety to be enhanced by preventing incorrect refitting of the head 1. Furthermore, ring of wire element 5 is manufactured in plant with well-mastered stitching methods thereby ensuring a good mechanical resistance of the wire element 5.

The document US 2004/0035992 discloses a camming chock that is provided with a single strap ring. The ring is passed through by the pivot shaft of the cams and extends through the hollow rod so as to open onto the other side of the rod. The strap ring is installed without tension so that the strap end may exit at the head and be damaged. To place the chock in a crack, it is necessary to hold the rod by placing the forefinger and the middle finger on the two ends of trigger and placing the thumb against the end of the rod opposite the head. The strap being installed free, it is to be expected that the thumb presses the two thicknesses of strap against the end of the rod. This configuration is not practical and results in premature wear of the strap which is systematically pressed against the rod.

It is also apparent that according to the teaching of the document US 2004/0035992, replacement of the strap ring necessarily requires the pivot shaft to be removed which implies a good mastery of the refitting process. As an alternative, the strap is cut and a new strap is then inserted before a stitching step is performed that will define the ring providing the mechanical continuity. There again, the stitching process has to be perfectly mastered which makes it difficult for the final user to perform a maintenance operation. No configuration exists in the prior art enabling the final user to correctly master maintenance of a camming chock. It should also be underlined that the variation of length of the textile loop requires the use of springs in order to move the annular end away from the rod to stretch the wire element. It is apparent from the configuration illustrated in the document US 2004/0035992 that replacement of the textile loop requires a splicing step to be performed after the two springs have been installed, which makes a strap replacement operation almost impossible for an average user.

The invention claimed is:

1. Camming clamping device comprising:

a head having at least one cam, at least one pivot shaft, and at least one spring, the at least one cam being mounted movable swivelling around the at least one pivot shaft, the at least one cam being movable between a retracted position and an extended position, the at least one spring being functionally coupled to the at least one cam to bias the at least one cam to the extended position;

an annular end mechanically coupled to the head, the annular end delineating a through hole;

a wire element in the form of a ring;

an actuating system coupled to the at least one cam, the actuating system being configured to selectively engage the retracted position, the actuating system having a trigger installed slidingly along a first direction connecting the head and the annular end;

wherein the ring defines at least a first leg and a second leg separate from the first leg, each comprising a top end, a bottom end and two strands of the wire element, the first leg and the second leg each mechanically connecting the head and the annular end;

wherein the two strands of the first leg are not part of the second leg, and the two strands of the second leg are not part of the first leg;

wherein the two strands of the first leg join up in the top end to form a first loop attached to the head;

the first and second loops being separate from each other;

wherein the two strands of the second leg join up in the top end to form a loop attached to the head;

and wherein the bottom end of each of the first leg and the second leg is extended by a connecting portion, the connecting portion connecting the two strands of the first leg to the two strands of the second leg, the connecting portion delineating said through hole.

2. Camming clamping device according to claim 1 wherein the wire element passing round an anchorage to form one of the loops attaching the at least one wire element to the head, the anchorage being fixed to the head and wherein the wire element is installed sliding with respect to the anchorage, the at least one wire element being able to slide along the first direction.

3. Camming clamping device according to claim 1 comprising a rod extending from the head up to the annular end and wherein the rod is hollow and the two strands of the first leg and the two strands of the second leg passing through the rod to connect the head to the annular end.

4. Camming clamping device according to claim 3 wherein the rod is adjustable in length in the first direction.

5. Camming clamping device according to claim 1 wherein the loop of the first leg and the loop of the second leg are attached to at least one anchorage installed in removable manner with respect to the head and wherein the at least one anchorage passes through at least the loop of the first leg and the loop of the second leg.

6. Camming clamping device according to claim 5 wherein the removable anchorage is located at a distance from the at least one pivot shaft, between the at least one pivot shaft and the annular end in the first direction.

7. Camming clamping device according to claim 1 wherein the head has a body supporting the at least one pivot shaft and wherein each loop passes round the at least one pivot shaft to attach the wire element with the head and wherein the head is pass-through to let the loops pass.

8. Camming clamping device according to claim 1 wherein the head has a body supporting the at least one pivot shaft, the body being pass-through to let the loops pass and wherein the loops each form a cow hitch throttling the body to secure the wire element with the head.

9. Method for replacing a wire element of a camming clamping device comprising the following steps:

providing a camming clamping device according to claim 1;

removing the wire element connecting the head and the annular end;

providing a new wire element in the form of a ring;

folding the ring to define a first leg and a second leg each comprising a top end, a bottom end and two strands of the wire element, the two strands joining one another in the top end to form a loop for each leg and wherein the bottom end of each leg is extended by a connecting portion, the connecting portion connecting the legs to one another, the connecting portion delineating the through hole of the annular end;

attaching the loops to the head to mechanically couple the annular end with the head, the at least one wire element mechanically connecting the head and the annular end.

10. Camming clamping device according to claim 1, wherein the first loop and second loop being spaced along a swivelling axis of the at least one cam; and wherein one strand of the first leg and one strand of the second leg join up in the bottom end to form a third loop, and another strand of the first leg and another strand of the second leg join up in the bottom end to form a fourth loop.

11. Camming clamping device according to claim 10, wherein the third loop is disposed inside the fourth loop.

12. Camming clamping device according to claim 1, wherein the connecting portion defines a third loop passing round the through hole and a fourth loop passing round the through hole;

wherein the first loop is separated from the second loop by the third loop along a longitudinal direction of the wire element;

wherein the third loop is separated from the fourth loop by the first loop along a longitudinal direction of the wire element.

13. Method for manufacturing a camming clamping device comprising the following steps:

providing a head having at least one cam, at least one pivot shaft, and at least one spring, the at least one cam being installed movable swivelling around the at least one pivot shaft, the at least one cam being movable between a retracted position and an extended position, the at least one spring being functionally coupled to the at least one cam to bias the at least one cam to the extended position;

providing an actuating system coupled to the at least one cam, the actuating system being configured to selectively engage the retracted position, the actuating system having a trigger installed slidingly along a first direction connecting the head and the annular end;

providing a wire element in the form of a ring, the ring being folded to define a first leg and a second leg separate from the first leg, each comprising a top end, a bottom end and two strands of the wire element;

wherein the two strands of the first leg are not part of the second leg, and the two strands of the second leg are not part of the first leg;

wherein the two strands join one another in the top end to form a loop for each leg, the loops being separate from each other, wherein the bottom end of each leg is extended by a connecting portion, the connecting portion connecting the first leg to the second leg, the connecting portion at least partially forming an annular end delineating a through hole;

attaching the loops to the head to mechanically couple the annular end with the head, the wire element mechanically connecting the head and the annular end.

* * * * *